US011083352B2

(12) United States Patent
Sanders et al.

(10) Patent No.: US 11,083,352 B2
(45) Date of Patent: Aug. 10, 2021

(54) MOTOR COVER FOR WET/DRY VACUUM CLEANER WITH INTEGRATED HOSE RETAINER

(71) Applicant: Emerson Electric Co., St. Louis, MO (US)

(72) Inventors: Jeremy Sanders, St. Louis, MO (US); Taylor M. Fauss, Florissant, MO (US); Matthew A. Williams, Bridgeton, MO (US)

(73) Assignee: Emerson Electric Co., St. Louis, MO (US)

( * ) Notice: Subject to any disclaimer, the term of this patent is extended or adjusted under 35 U.S.C. 154(b) by 224 days.

(21) Appl. No.: 16/264,193

(22) Filed: Jan. 31, 2019

(65) Prior Publication Data

US 2020/0245830 A1 Aug. 6, 2020

(51) Int. Cl.
*A47L 9/00* (2006.01)
*A47L 9/28* (2006.01)

(52) U.S. Cl.
CPC ..... *A47L 9/0036* (2013.01); *A47L 9/28* (2013.01)

(58) Field of Classification Search
CPC ..... A47L 5/365; A47L 9/0036; A47L 9/28
See application file for complete search history.

(56) References Cited

U.S. PATENT DOCUMENTS 5,303,447 A 4/1994 McKnight
6,106,182 A 8/2000 Hamm et al.
6,175,988 B1 1/2001 White et al.
6,502,276 B2 1/2003 Iversen
D549,904 S 8/2007 Eccardt et al.
D666,369 S 8/2012 Williams et al.
D670,048 S 10/2012 Theising et al.
8,695,154 B2 4/2014 Sever et al.
9,282,861 B2 3/2016 Schultz et al.
(Continued)

FOREIGN PATENT DOCUMENTS

WO WO-2012062580 A1 * 5/2012 ..... A47L 9/0036
WO WO-2014194820 A1 * 12/2014 ..... A47L 9/248

OTHER PUBLICATIONS

Craftsman 12004 6 Gallon 3 Peak HP Wet/Dry Vac; https://www.amazon.com/Craftsman-12004-Gallon-Peak-Wet/dp/B00J2AR5FC; pp. 1-8.
(Continued)

*Primary Examiner* — Marc Carlson
(74) *Attorney, Agent, or Firm* — Armstrong Teasdale LLP

(57) ABSTRACT

A vacuum cleaner includes a canister defining a debris chamber, a vacuum hose adapted for fluid connection to the debris chamber, a lid mounted to the canister, and a motor cover mounted to the lid and including at least one hose retainer. The hose retainer includes at least two ribs and a retention portion attached to the ribs. The ribs and the retention portion are spaced from a central portion of the motor cover to define an insertion opening. The ribs and the retention portion deflect away from a retention position in a first direction to an open position when the vacuum hose is inserted through the insertion opening. The ribs and the retention portion are biased in a second direction towards the retention position such that the ribs exert a positive retention force on the vacuum hose when the vacuum hose is positioned within the hose retainer.

20 Claims, 8 Drawing Sheets

(56) References Cited

U.S. PATENT DOCUMENTS

| | | | | |
|---|---|---|---|---|
| 9,468,345 | B2 * | 10/2016 | Zhu | A47L 9/0036 |
| 9,795,262 | B2 | 10/2017 | Bosses et al. | |
| 10,231,589 | B2 * | 3/2019 | Bian | A47L 9/0036 |
| D865,305 | S * | 10/2019 | Wall | D32/21 |
| 2013/0125335 | A1 * | 5/2013 | Robinson | A47L 9/009 15/320 |
| 2015/0342427 | A1 * | 12/2015 | Zhu | A47L 5/365 15/323 |
| 2018/0132682 | A1 | 5/2018 | Bearup et al. | |
| 2019/0328192 | A1 * | 10/2019 | Wilsey | A47L 9/0036 |

OTHER PUBLICATIONS

Rigid 12 Gal. 5.0-Peak HP Wet/Dry Vacuum; https://www.homedepot.com/p/RIDGID-12-Gal-5-0-Paek-HP-Wet-Dry-Vacuum-WD1270; pp. 1-5.

* cited by examiner

MOTOR COVER FOR WET/DRY VACUUM CLEANER WITH INTEGRATED HOSE RETAINER

FIELD

The field of the disclosure relates generally to vacuum cleaners and, more particularly, to hose storage systems for vacuum cleaners.

BACKGROUND

Some vacuum appliances, in particular vacuum cleaners, include lid-mounted motors that facilitate the movement of air using a motor and an impeller connected to the motor. Some vacuum cleaners also include hoses to facilitate collection of debris or liquids and hose storage systems to facilitate storage of the hose. Typical hose storage systems include a retention device configured to retain the hose within the hose storage system. However, some known retention devices loosely retain the hose within the hose storage system because, for example, the retention device does not exert a positive retention force on the hose.

Additionally, some hose storage systems require final assembly by the manufacturer or the customer. Typically, the manufacturer or the customer assembles the hose storage system by fastening the retention device to a portion of the vacuum. However, the fit of the hose within the retention device and/or the hose storage system can vary based on manufacturing tolerances of the components and due to the assembly process. Also, some customer assembled hose storage systems require the customer to install the retention device with screws that fasten the retention device to the vacuum cleaner. If the customer installs the hose storage system incorrectly, the sealed vacuum flow path may be punctured or broken, leading to a decrease in vacuum performance. A more reliable and more cost effective hose storage system is needed.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a vacuum cleaner includes a canister defining a debris chamber, a vacuum hose adapted for fluid connection to the debris chamber, a lid mounted to a top of the canister, and a motor cover mounted to a top of the lid and including at least one hose retainer. The hose retainer includes at least two ribs and a retention portion attached to the ribs. The ribs and the retention portion are spaced from a central portion of the motor cover to define an insertion opening. The ribs and the retention portion deflect away from a retention position in a first direction to an open position when the vacuum hose is inserted through the insertion opening. The ribs and the retention portion are biased in a second direction towards the retention position such that the ribs exert a positive retention force on the vacuum hose when the vacuum hose is positioned within the hose retainer.

In another aspect, a hose storage system for storage of a vacuum hose for a vacuum cleaner includes a motor cover for housing at least a motor of the vacuum cleaner, and a hose retainer attached to the motor. The motor cover is free of sealing surfaces, and the hose retainer and the motor have a unitary construction. The hose retainer includes at least two ribs and a retention portion attached to the ribs. The ribs and the retention portion are spaced from a central portion of the motor cover to define an insertion opening. The ribs and the retention portion deflect away from a retention position in a first direction to an open position when the vacuum hose is inserted through the insertion opening. The ribs and the retention portion are biased in a second direction towards the retention position such that the ribs exert a positive retention force on the vacuum hose when positioned within the hose retainer.

In yet another aspect, a lid system for a vacuum cleaner includes a lid having an outer perimeter, a motor cover mounted to the top of the lid, and at least one hose retainer mounted to the motor cover at a location inward of the outer perimeter of the lid. The hose retainer includes at least two ribs and a retention portion attached to the ribs. The ribs and the retention portion are spaced from the motor cover to define an insertion opening. The ribs and the retention portion deflect away from a retention position in a first direction to an open position when a vacuum hose is inserted through the insertion opening. The ribs and the retention portion are biased in a second direction towards the retention position such that the ribs exert a positive retention force on the vacuum hose when positioned within the hose retainer.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
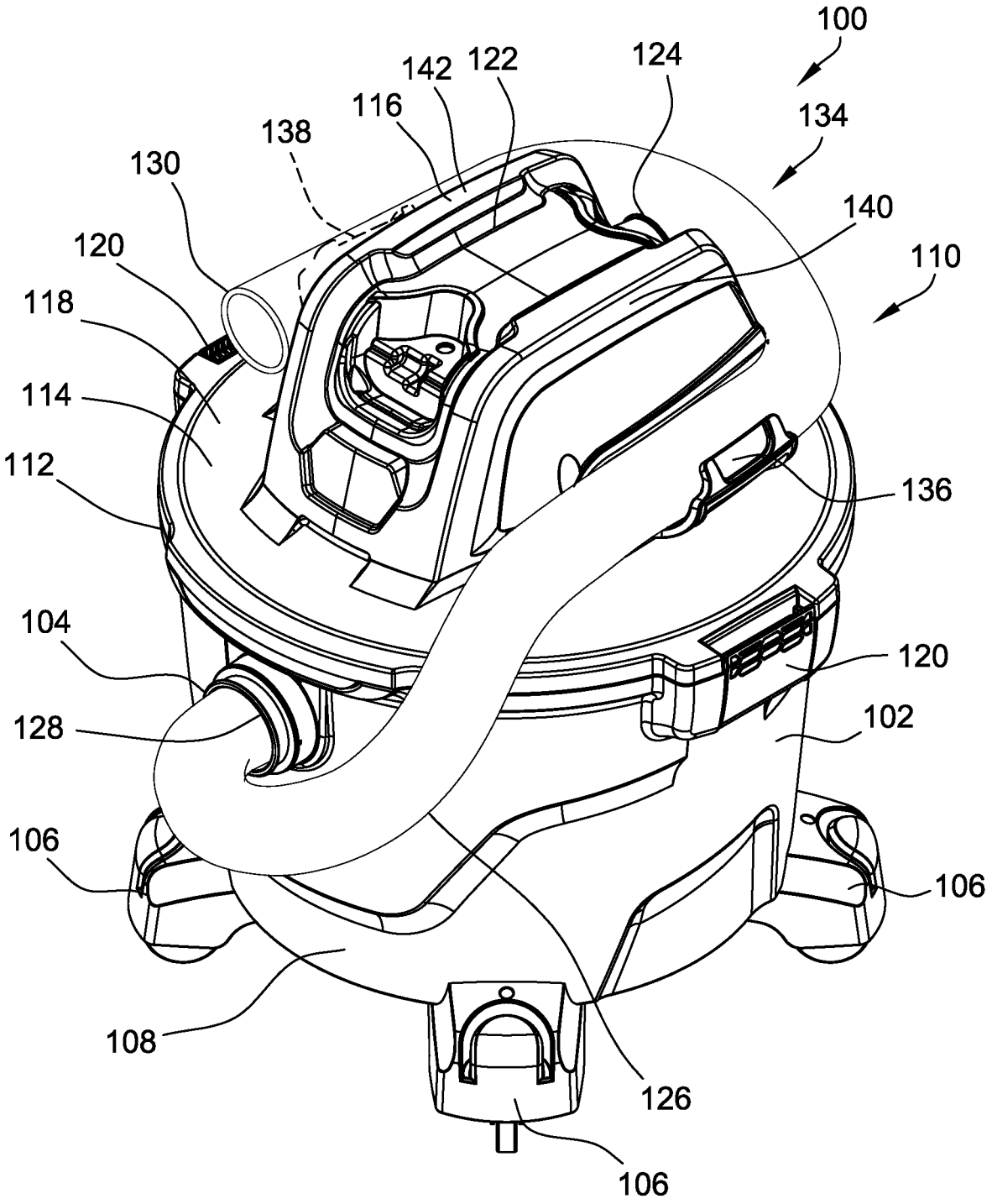
FIG. 1 is a perspective view of an example vacuum cleaner.
Figure 2:
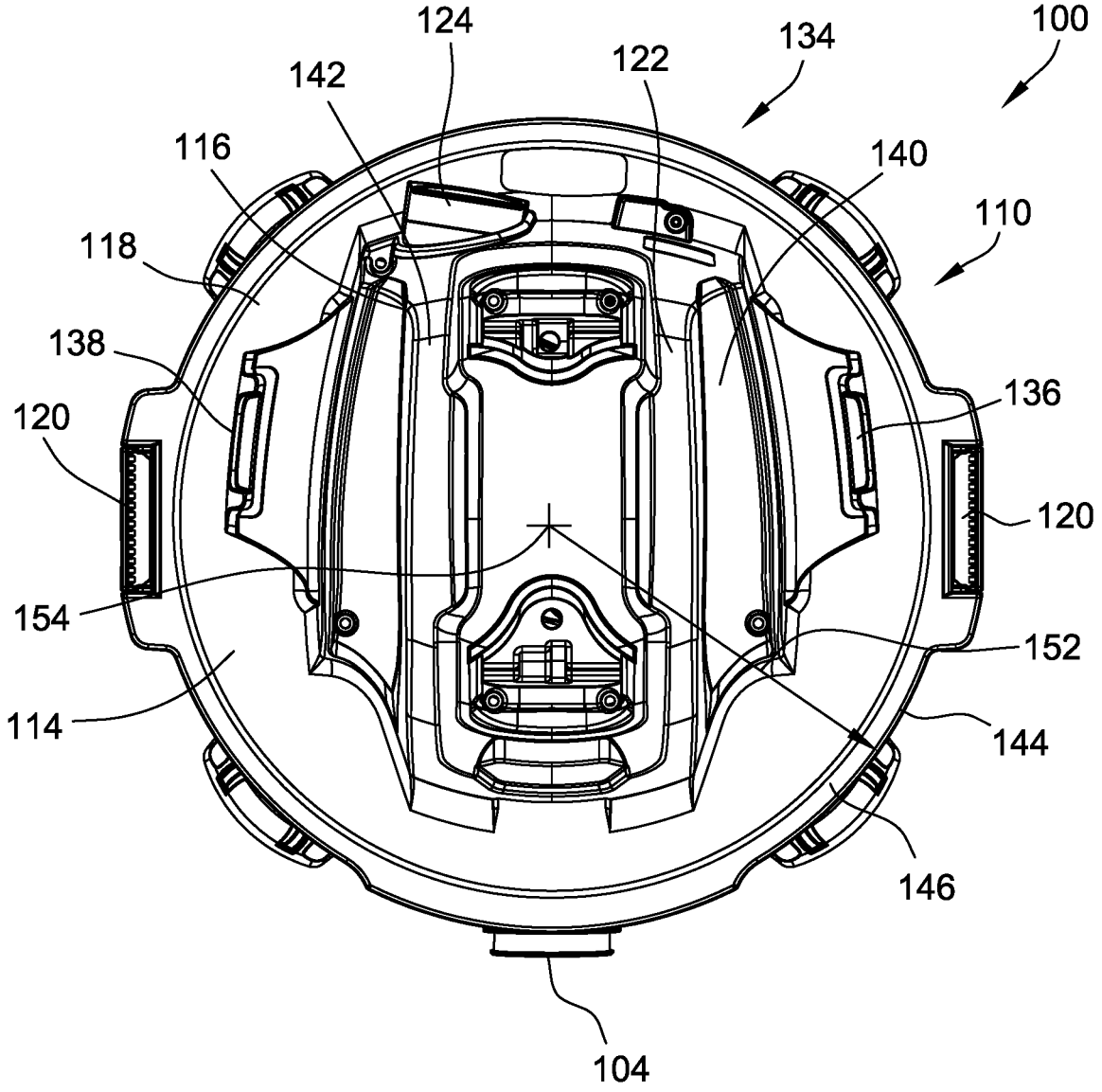
FIG. 2 is a top view of the vacuum cleaner shown in FIG. 1.
Figure 3:
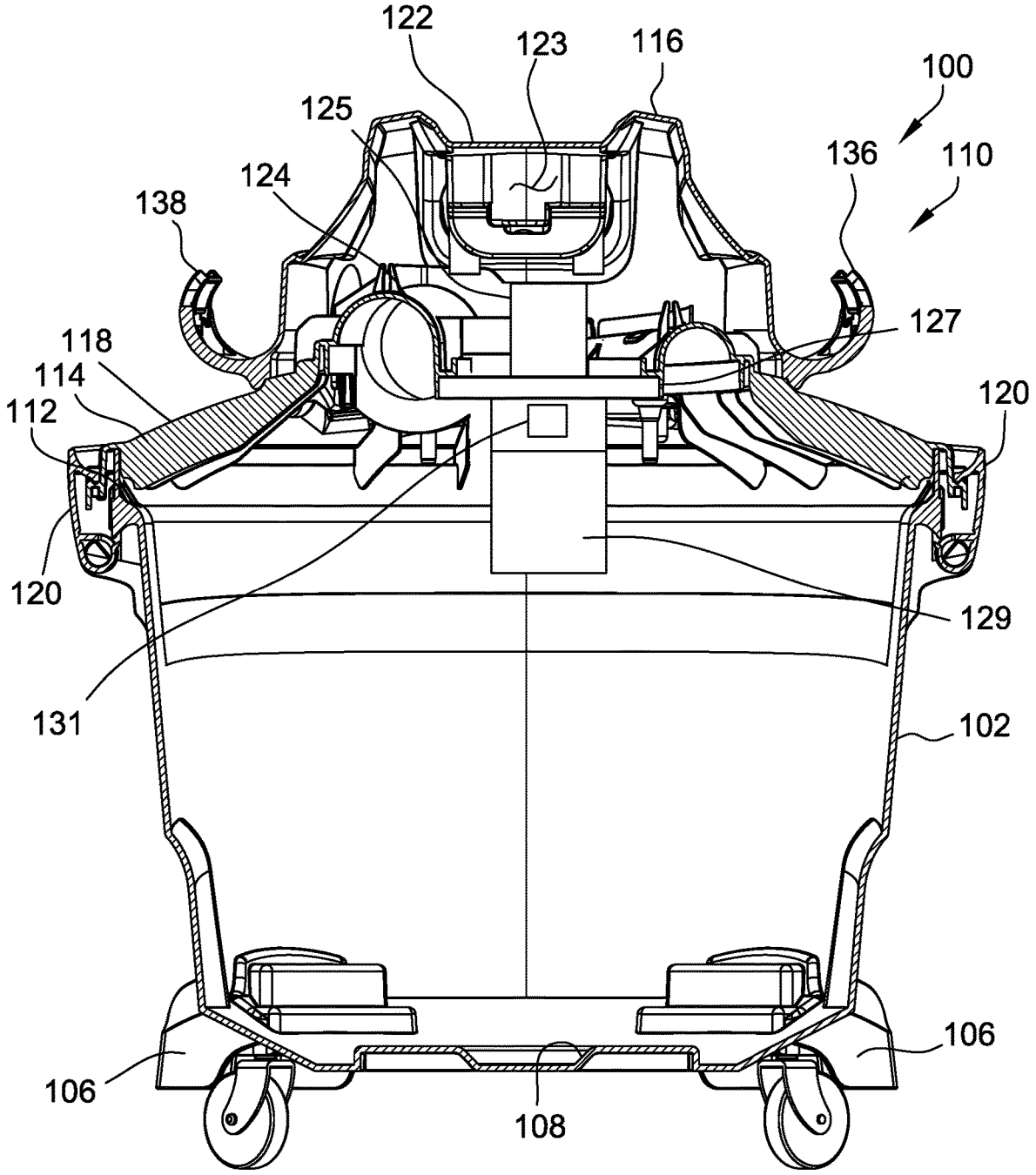
FIG. 3 is a side sectional view of the vacuum cleaner shown in FIG. 1.

Referring to FIGS. 1-3, an example vacuum cleaner 100 includes a collection drum or canister 102 defining an inlet 104, caster feet and casters 106 mounted on a bottom end 108 of the canister 102, and a lid system 110 removably mounted to a top end 112 of the canister 102. The lid system 110 includes a lid 114 and a motor cover 116 mounted to an upper surface 118 of the lid 114. The lid 114 is removably attached (e.g., via a hinge mechanism or latches 120) to the canister 102 so that the lid 114 can be readily removed to empty debris or liquids contained within the canister 102.

The motor cover 116 includes a housing or central portion 122. As shown in FIG. 3, the central portion 122 is mounted to the upper surface 118 of the lid 114 such that the lid 114 and the central portion 122 define a motor cavity 123. A motor 125 is mounted to the upper surface 118 of the lid 114 within motor cavity 123, and a fan or impeller 127 (collectively referred to as an impeller assembly) is coupled to the motor 125 and is located within an impeller chamber defined by the lid 114. The impeller assembly is operable to generate airflow through the canister 102 from the inlet 104 to an outlet 124 (shown in FIGS. 2 and 3) so as to draw solid debris, liquid, or both into a debris chamber defined by the canister 102. In the example embodiment, the inlet 104 is defined by the canister 102, and the outlet 124 is defined by the lid 114. In other embodiments, the inlet 104 and the outlet 124 may be defined by any suitable portion of the vacuum cleaner 100 that enables the vacuum cleaner 100 to function as described herein. In some embodiments, for example, the inlet 104 may be defined by the motor cover 116 or the lid 114, and the outlet 124 may be defined by the canister 102 or the motor cover 116.

In the illustrated embodiment, the vacuum cleaner 100 further includes a filter assembly 129 connected to, and depending downward from, the lid 114 within the canister 102. In operation, when the motor 125 is energized, air flows into the canister 102 through the inlet 104, through the filter assembly 129, and is exhausted back into an environment surrounding the vacuum cleaner 100 through the outlet 124.

Although the vacuum cleaner 100 is shown and described with reference to a wet/dry vacuum cleaner, the vacuum cleaner 100 and features thereof may be embodied in vacuum cleaners other than wet/dry vacuum cleaners including, for example and without limitation, canister vacuum cleaners, backpack vacuum cleaners, and upright vacuum cleaners.

The vacuum cleaner 100 includes a vacuum cleaner hose 126 adapted for fluid connection to the debris chamber, and may also include a plurality of vacuum cleaner accessories (not shown). As used herein, the term "vacuum cleaner hose" or "hose" refers to a flexible conduit of a vacuum cleaner that is connected, directly or indirectly, to a vacuum cleaner inlet 104 or outlet 124 to direct airflow or suction generated by the vacuum cleaner 100. In the illustrated embodiment, a proximal end 128 of the vacuum cleaner hose 126 is connected to the inlet 104, and permits fluid communication between a suction or distal end 130 of the vacuum hose 126 and the vacuum cleaner 100. One or more vacuum cleaner accessories (e.g., surface cleaning tools, not shown) may be connected to the distal end 130 of the vacuum cleaner hose 126 to facilitate manipulation of the vacuum cleaner hose 126 and directing suction to a desired area to be cleaned.

Figure 8:
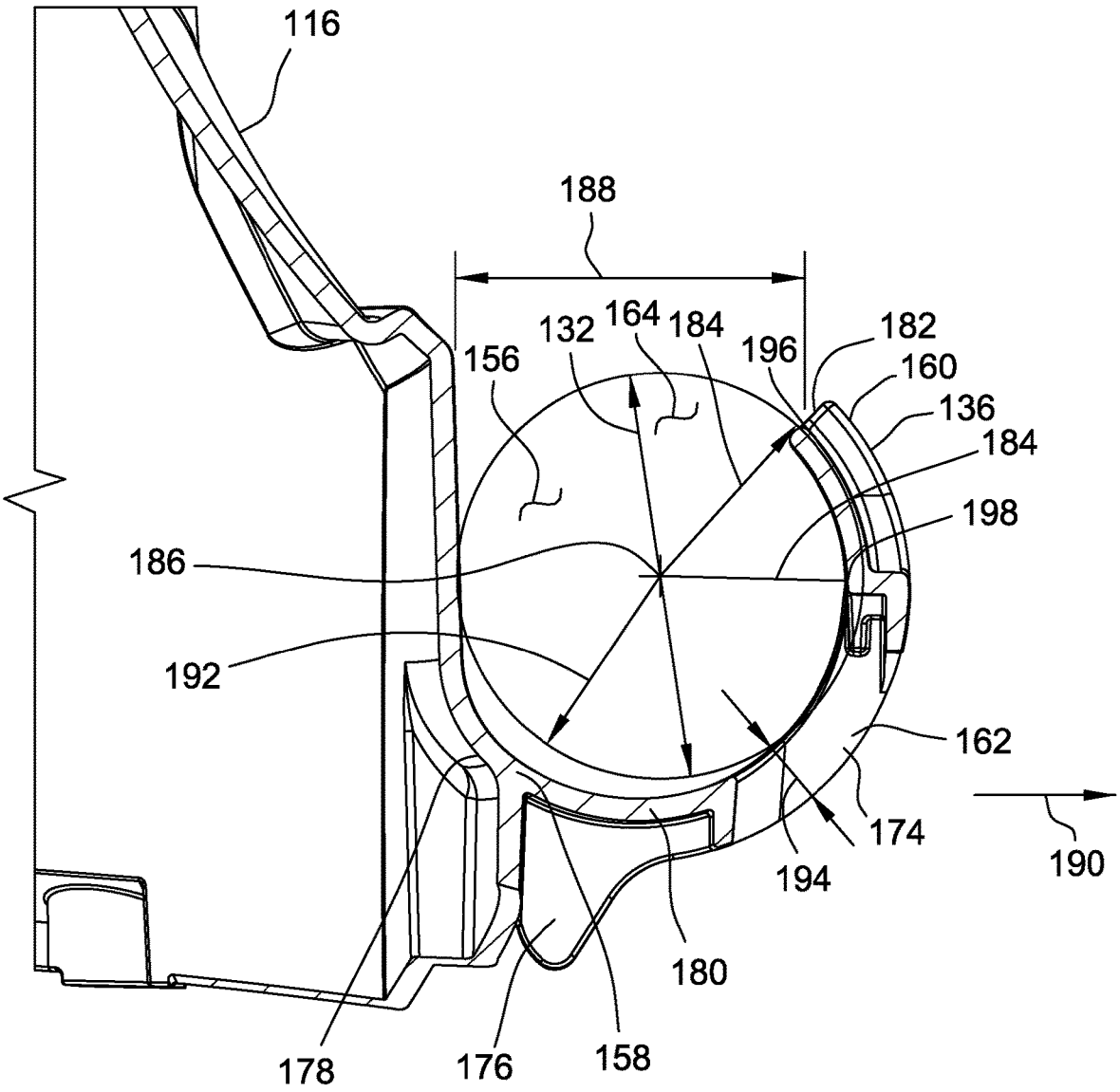
FIG. 8 is a front sectional view of the hose retainer shown in FIG. 4.

The vacuum cleaner hose 126 has a hose diameter 132 (shown in FIG. 8). In the illustrated embodiment, the hose diameter 132 is between 1.5 inches and 2.0 inches. More specifically, in the illustrated embodiment, the hose diameter 132 is 1.875 inches. In alternative embodiments, the hose diameter 132 may be any diameter that enables the vacuum cleaner 100 to operate as described herein including, for example and without limitation, between 1.0 inches and 3.0 inches, such as 1.25 inches or 2.50 inches.

The vacuum cleaner 100 also includes a hose storage system 134. Specifically, in the illustrated embodiment, the hose storage system 134 includes at least one hose retainer 136, 138 connected to the motor cover 116 to facilitate retention and storage of the vacuum cleaner hose 126 when the vacuum cleaner 100 is not in use. More specifically, in the illustrated embodiment, the motor cover 116 includes a first hose retainer 136 attached to a first side 140 of the motor cover 116, and a second hose retainer 138 attached to a second side 142 of the motor cover 116 opposite the first side 140 to facilitate retention and storage of the vacuum cleaner hose 126 when the vacuum cleaner 100 is not in use. Thus, in the illustrated embodiment, the hose storage system 134 includes the motor cover 116 and two hose retainers 136, 138. The hose retainers 136, 138 of the illustrated embodiment are integrally formed with the motor cover 116 and are positioned on the motor cover 116 such that the vacuum cleaner hose 126 is wound around the motor cover 116 when in a stored configuration. In alternative embodiments, the motor cover 116 and/or the hose storage system 134 may include any number of hose retainers 136, 138 that enables the vacuum cleaner 100 to operate as described herein, including and without limitation, one, three, four, or more hose retainers.

In the illustrated embodiment, the hose retainers 136, 138 are positioned on the motor cover 116 such that the hose retainers 136, 138 exert an inward positive retention force on the vacuum cleaner hose 126 that maintains the vacuum cleaner hose 126 in a stored configuration, as shown in FIG. 1. In alternative embodiments, the hose storage system 134 and the hose retainers 136, 138 may be positioned on other parts of the vacuum cleaner 100, including and without limitation, the canister 102 and/or the lid 114. The hose storage system 134 and the hose retainers 136, 138 may be positioned on any part of the vacuum cleaner 100 that enables the vacuum cleaner 100 to store the vacuum cleaner hose 126 when it is not in use. Additionally, the hose storage system 134 and the hose retainers 136, 138 and features thereof may be embodied in vacuum cleaners other than wet/dry vacuum cleaners including, for example and without limitation, canister vacuum cleaners, backpack vacuum cleaners, and upright vacuum cleaners.

With additional reference to FIGS. 2-5, the lid 114 has a substantially circular, disc shape with the hinge mechanisms or latches 120 positioned on diametrically opposite sides of the lid 114. The lid 114 has an outer perimeter 144, a perimeter sealing surface 146, and a motor cover mount 148. The motor cover mount 148 and a bottom end 150 of the motor cover 116 are shaped complementary to one another such that motor cover 116 is substantially flush with the upper surface 118 of the lid 114 when the motor cover 116 is attached to motor cover mount 148. The motor cover 116 and the lid 114 define the motor cavity 123. The motor 125 is positioned within the motor cavity 123, and is connected to the impeller 127 generate suction within the canister 102 and the vacuum cleaner hose 126.

In the illustrated embodiment, the outer perimeter 144 extends around the canister 102, and the perimeter sealing surface 146 is adjacent the outer perimeter 144. The perimeter sealing surface 146 is configured to form a perimeter seal between the lid 114 and the canister 102 adjacent the outer perimeter 144. For example, the perimeter sealing surface 146 suitably includes a rubber disk or other sealing member that forms an air-tight seal with the canister 102 when the lid 114 is attached to the canister 102 (e.g., via latches 120). The motor and the impeller generate suction within the canister 102 and the vacuum cleaner hose 126, and the perimeter seal maintains the suction by preventing atmospheric air from entering the canister 102. As such, when the lid 114 is mounted on the top end 112 of the canister 102 such that the perimeter seal is formed between the lid 114 and the canister 102, the lid 114, the canister 102, and the vacuum cleaner hose 126 define a sealing surface of the vacuum cleaner 100. The suction generated by the motor and the impeller draws a flow of air into the vacuum cleaner hose 126 and the canister 102 before it is discharged from the canister 102 through the outlet 124. A sealing surface of the vacuum cleaner 100 refers to a surface of a component of the vacuum cleaner 100 that is joined or connected to another component of the vacuum cleaner 100 to cooperatively form a sealed vacuum flow path, where the sealing surface defines at least a portion of the sealed vacuum flow path. Maintaining the integrity of the sealing surfaces of the vacuum cleaner 100 facilitates maintaining vacuum, and therefore suction, during operation of the vacuum cleaner 100.

Conversely, any portion of the vacuum cleaner 100 that is not a sealing surface defines a non-sealing surface of the vacuum cleaner 100. In the illustrated embodiment, the motor cover 116 does not channel the flow of air and is not part of a sealing surface of the vacuum cleaner 100. As such, the motor cover 116 is a non-sealing surface, or is free of sealing surfaces, and at least partially defines a non-sealing surface of the vacuum cleaner 100. Accordingly, holes or voids within the motor cover 116 will not compromise the seal of the vacuum cleaner 100, and will not adversely affect suction. For example, the interface between the motor cover mount 148 and the bottom end 150 of the motor cover 116 is not air-tight, but does not compromise the structural integrity of the sealing surfaces of the vacuum cleaner 100.

The hose retainers 136, 138 are suitably attached to a non-sealing surface of the vacuum cleaner 100. Specifically, the hose retainers 136, 138 are attached to motor cover 116. More specifically, the hose retainers 136, 138 are attached to the central portion 122 of the motor cover 116. As discussed below, the hose retainers 136, 138 define an opening 168 which allows the motor cover 116 and the hose retainers 136, 138 to be molded as a single component and have a unitary construction. If these hose retainers were integrally molded with the lid 114, for example, they would need to be located radially outward of the of the lid outer perimeter 144 in order to not compromise the integrity of the sealing surfaces of the vacuum cleaner 100. Attaching the hose retainers 136, 138 to a non-sealing surface of the vacuum cleaner 100 (e.g., the motor cover 116) allows the hose retainers 136, 138 to include opening 168 without compromising the integrity of the sealing surfaces of the vacuum cleaner 100.

As shown in FIG. 2, lid 114 also has a lid radius 152 extending from a center 154 of the lid 114 to outer perimeter 144. The hose retainers 136, 138 are attached to the non-sealing surface of the vacuum cleaner 100 at a location radially inward of outer perimeter 144. As discussed above, the perimeter sealing surface 146 creates the perimeter seal between the lid 114 and the canister 102 adjacent the outer perimeter 144. Attaching the hose retainers 136, 138 radially outward of the outer perimeter 144 (e.g., to the perimeter sealing surface 146) may compromise the integrity of the sealing surfaces of the vacuum cleaner 100 because the opening 168 may extend through the lid 114, creating a hole or void in the sealing surface of the vacuum cleaner 100. Attaching the hose retainers 136, 138 to a non-sealing surface of the vacuum cleaner 100, specifically the motor cover 116, allows the hose retainers 136, 138 to be located radially inward from the outer perimeter 144, thereby reducing the footprint of the vacuum cleaner 100, while at the same time preserving the integrity of the sealing surfaces of the vacuum cleaner 100.

Figure 4:
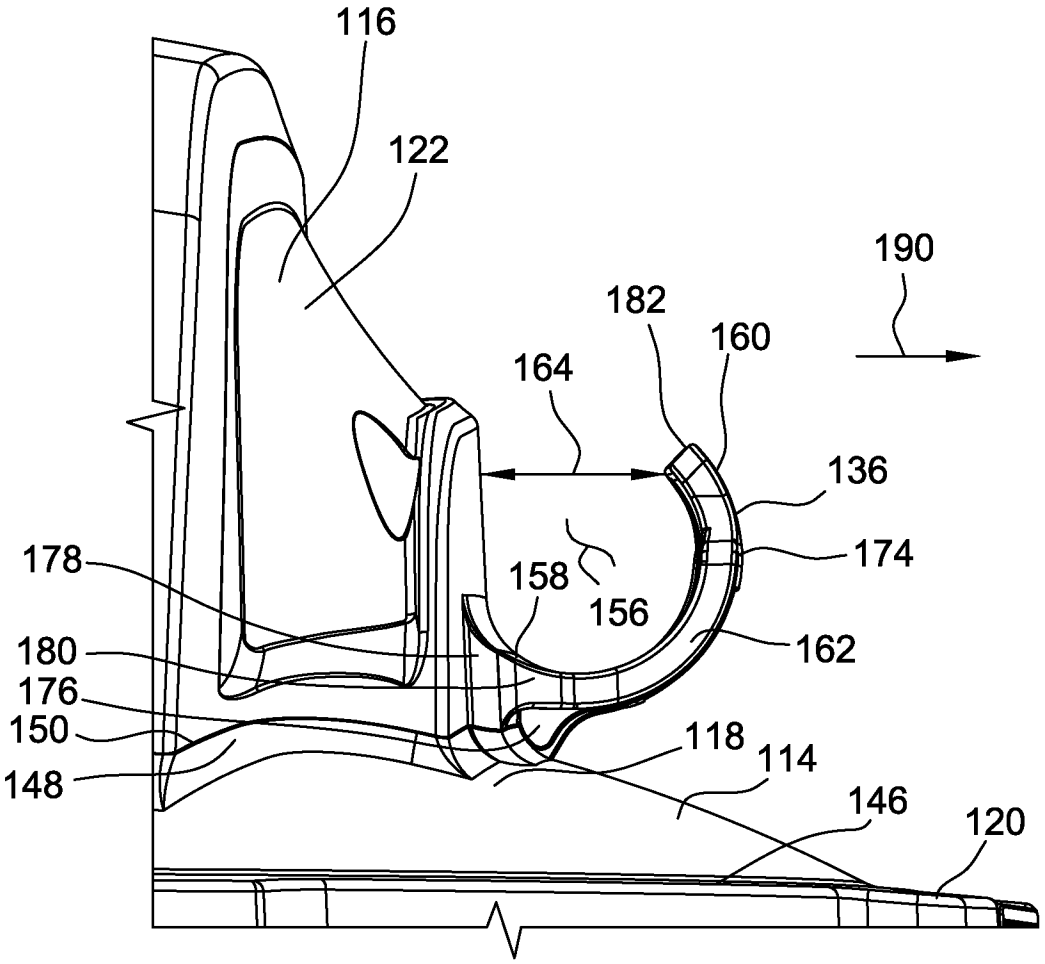
FIG. 4 is a front view of a motor cover, a lid, and a hose retainer suitable for use with the vacuum cleaner shown in FIG. 1.
Figure 5:
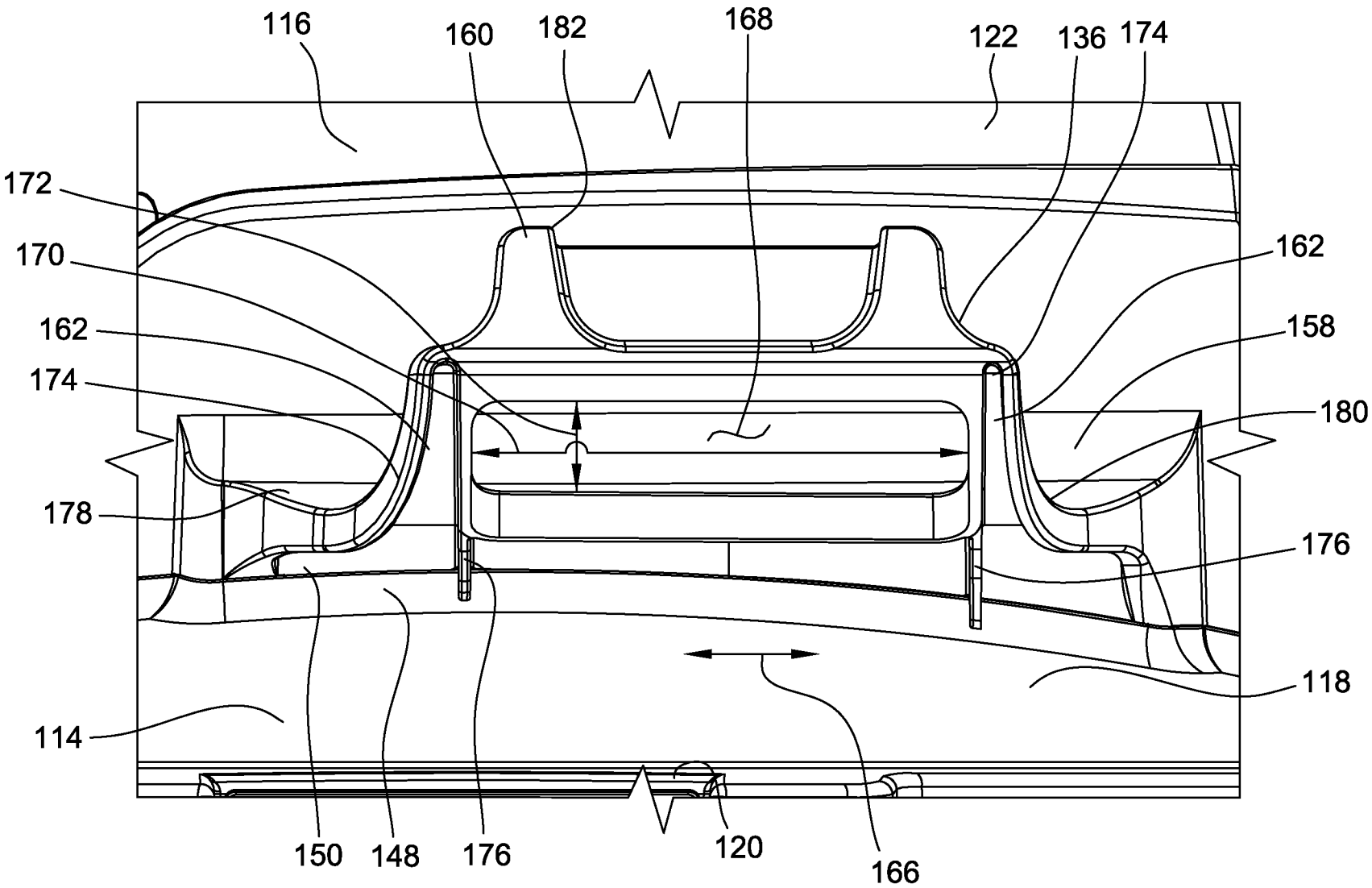
FIG. 5 is a side view of the motor cover, the lid, and the hose retainer shown in FIG. 4.
Figure 6:
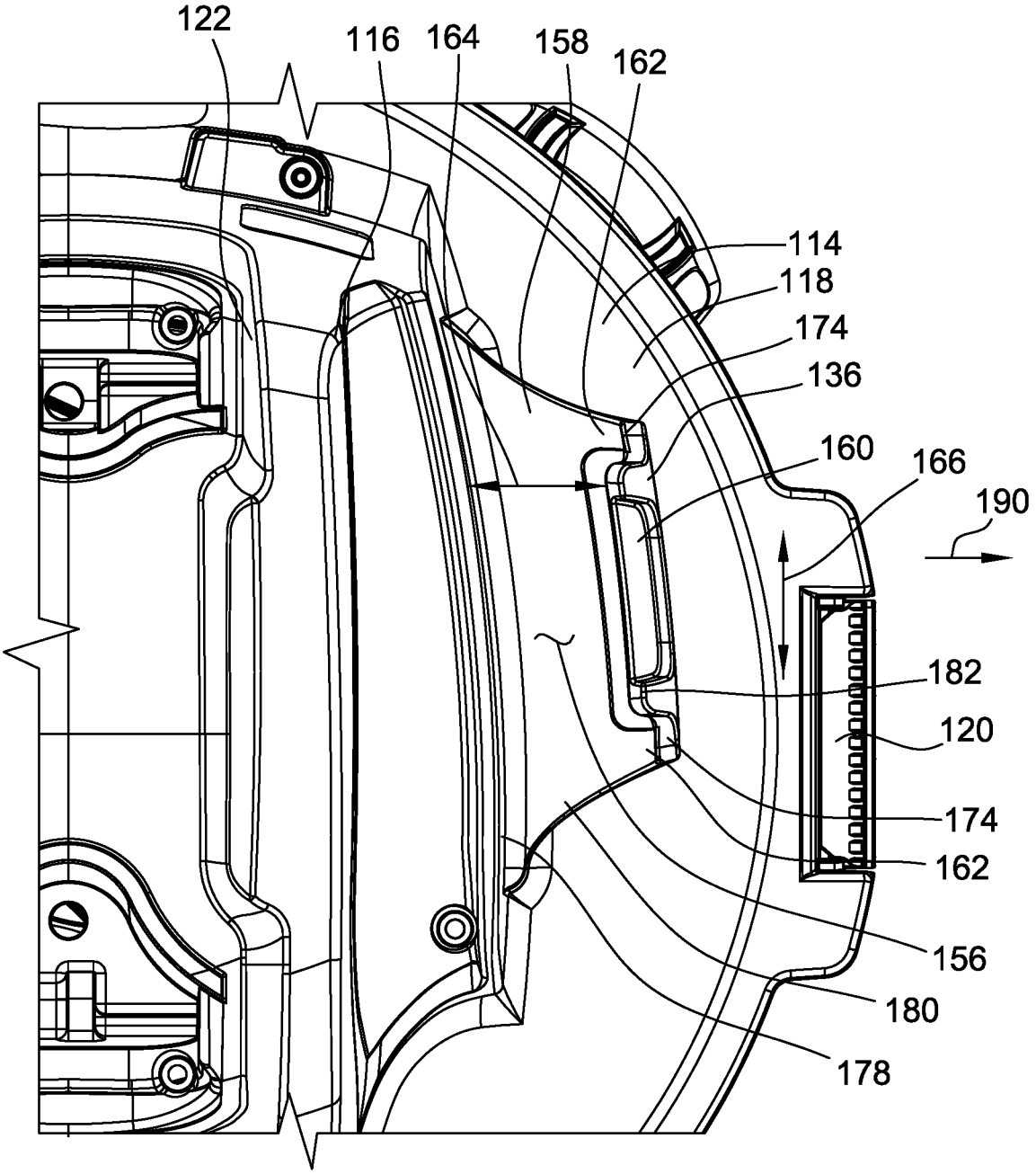
FIG. 6 is a top view of the motor cover, the lid, and the hose retainer shown in FIG. 4.
Figure 7:
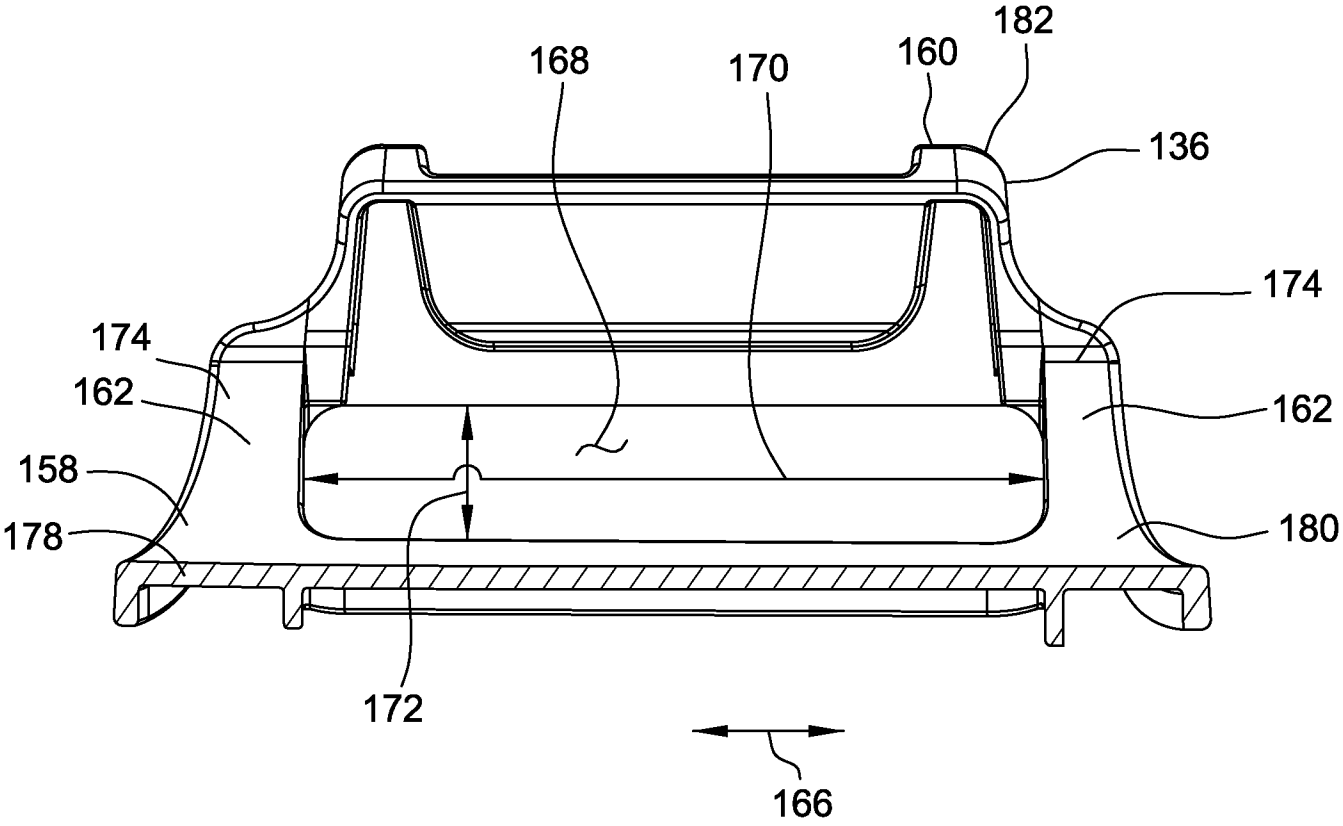
FIG. 7 is a side sectional view of the hose retainer shown in FIG. 4.

FIG. 4 is a front view of the motor cover 116, the lid 114, and the first hose retainer 136. FIG. 5 is a side view of the motor cover 116, the lid 114, and the first hose retainer 136. FIG. 6 is a top view of the motor cover 116, the lid 114, and the first hose retainer 136. FIG. 7 is a side sectional view of the first hose retainer 136. Although the first hose retainer 136 is shown and described with reference to FIGS. 4-8, it should be understood that the second hose retainer 138 may have the same construction and function as the first hose retainer 136.

As shown in FIGS. 4-8, the hose retainer 136 and the central portion 122 of the motor cover 116 define a hose retention area 156 configured to receive and retain the vacuum cleaner hose 126. Specifically, the hose retainer 136 extends from the central portion 122 of the motor cover 116 and is spaced from the central portion 122 of the motor cover 116, to form the hose retention area 156. As shown in FIG. 1, the vacuum cleaner hose 126 is wrapped around the central portion 122 of the motor cover 116 within the hose retention area 156 in the stored configuration.

The hose retainers 136, 138 each include a base portion 158 attached to the motor cover 116, a retention portion 160, and at least two ribs 162. The ribs 162, the retention portion 160, and the motor cover 116 define an insertion opening 164 configured to receive the vacuum cleaner hose 126. In the illustrated embodiment, the hose retainers 136, 138 include a single retention portion 160, a single base portion 158, and two ribs 162. In alternative embodiments, the hose retainers 136, 138 may include any number of retention portions, base portions, and ribs that enable the vacuum cleaner 100 to operate as described herein.

The ribs 162 and the retention portion 160 are configured to exert a positive retention force on the vacuum cleaner hose 126 when it is positioned within the respective hose retainer 136, 138. Specifically, the ribs 162 are configured to deflect away from a retention position (shown in FIGS. 1-8) to an open position upon insertion of the vacuum cleaner hose 126 through the insertion opening 164. The ribs 162 are biased towards the retention position such that the ribs 162 exert the positive retention force on the vacuum cleaner hose 126 when is positioned within the respective hose retainer 136, 138. Specifically, the material construction and geometry of the hose retainers 136, 138 relative to the vacuum cleaner hose 126 enables the hose retainers 136, 138 to exert the positive retention force on the vacuum cleaner hose 126.

In the illustrated embodiment, the base portion 158 extends from the central portion 122 of the motor cover 116, and the ribs 162 extend from the base portion 158. The ribs 162 are spaced apart from one another in a longitudinal direction 166 of the hose retainer 136, 138, and the retention portion 160 extends from one of the ribs 162 to the other of the ribs 162 such that the retention portion 160 is attached to both ribs 162. The ribs 162 are spaced apart from each other such that the ribs 162, the retention portion 160, and the base portion 158 define the opening 168 in the hose retainers 136, 138. The opening 168 enables the base portion 158, the ribs 162, and the retention portion 160 to be molded and integrally formed with the motor cover 116 during the manufacturing process such that the motor cover 116 and the hose retainers 136, 138 have a unitary construction. Specifically, the opening 168 is positioned relative to the ribs 162 and the retention portion 160 such that the ribs 162 may be manufactured in an injection mold with a single direction of motion.

In this example embodiment, the opening 168 has a length 170 and a width 172. The length 170 of the opening 168 is between 3.0 inches and 3.5 inches. Specifically, the length 170 of the opening 168 is between 3.2 inches and 3.4 inches. More specifically, the length 170 of the opening 168 is 3.3 inches. The width 172 of the opening 168 is between 0.5 inches and 1.0 inches. Specifically, the width 172 of the opening 168 is between 0.7 inches and 0.8 inches. More specifically, the width 172 of the opening 168 is 0.74 inches.

The retention portion 160 and the ribs 162 of this example have an arcuate or curved shape complementary to a cylindrical shape of the vacuum cleaner hose 126 such that an overall shape of the hose retainers 136, 138 is complementary to the cylindrical shape of the vacuum cleaner hose 126. In the illustrated embodiment, each of the ribs 162 includes a curved portion 174 and a rib tab 176 depending from the curved portion 174. The curved portion 174 extends from the base portion 158, and the rib tab 176 depends from the curved portion 174 toward the lid 114, specifically, towards the motor cover mount 148. The rib tabs 176 engage the upper surface 118 or the motor cover mount 148 of the lid 114 when the ribs 162 are in the open position to support the hose retainers 136, 138.

The base portion 158 is attached to the central portion 122 of the motor cover 116, and defines a proximal end 178 of the hose retainers 136, 138 attached to the motor cover 116. The curved portion 174 is attached to the base portion 158 at a curved-base portion interface 180, and extends to a free, distal end 182. The curved portion 174 defines a radius of curvature 184 with a center 186 positioned within the hose retention area 156. The hose retention area 156 defines an insertion width 188 between the distal end 182 and the central portion 122 of the motor cover 116.

During operation, vacuum cleaner hose 126 is removed from the hose retention area 156 for connection to the inlet 104, and is used to clean a surface. To store the vacuum cleaner hose 126, for example, following use of the vacuum cleaner 100, vacuum cleaner hose 126 is inserted into the hose retention area 156. The ribs 162 flex outwards or in a direction 190 away from the retention position to the open position during the insertion and removal processes. The ribs 162 are biased towards the retention position, and return to the retention position after the vacuum cleaner hose 126 is inserted into the hose retention area 156 and/or removed from the hose retention area 156.

The insertion width 188 is suitably in the range of about 65% to about 95% of the hose diameter 132 and, more suitably, in the range of about 75% to about 85% of the hose diameter 132. The insertion width 188 affects how far the ribs 162 will flex in the direction 190 during insertion of the hose 126. If the insertion width 188 is less than about 65% of the hose diameter 132, the ribs 162 may be subjected to high stress that can cause the ribs 162 to deform or break during the insertion process. If the insertion width 188 is greater than about 95% of the hose diameter 132, the ribs 162 may not adequately retain the vacuum cleaner hose 126 within the hose retention area 156.

The radius of curvature 184 of the ribs 162 in this example is not constant from the proximal end of the ribs 162 to the distal end 182. FIG. 8 is a sectional view of the hose retainer 136 and the vacuum cleaner hose 126 stored in the hose retention area 156. As shown in FIG. 8, the vacuum cleaner hose 126 has a constant hose diameter 132 and a constant hose radius 192. In contrast, the radius of curvature 184 of the ribs 162 is different at different points along the ribs 162, and the radius of curvature 184 of the ribs 162 is smaller than the hose radius 192. In the illustrated embodiment, the radius of curvature 184 of the ribs 162 is between 85% and 90% of the hose radius 192. Because the radius of curvature 184 of the ribs 162 is smaller than the hose radius 192, the ribs 162 exert a positive retention force on the vacuum cleaner hose 126. Specifically, the hose retainers 136, 138 partially compress the vacuum cleaner hose 126 because the radius of curvature 184 of the ribs 162 is smaller than the hose radius 192. However, because the radius of curvature 184 of the ribs 162 is not constant, the compression of the vacuum cleaner hose 126 by the ribs 162 and the retention force on the vacuum cleaner hose 126 varies by position. Additionally, the curved portion 174 has a thickness 194 of between 0.25 inches and 0.30 inches. More specifically, the thickness 194 of the curved portion 174 is 0.269 inches.

For example, the radius of curvature 184 at a first point 196 is different than the radius of curvature 184 at a second point 198. The radius of curvature 184 at the first point 196 is the radius of curvature 184 of a line from the center 186 of the hose retention area 156 to the distal end 182 of the rib 162. The radius of curvature 184 at the second point 198 is the radius of curvature 184 of a horizontal line from the center 186 of the hose retention area 156 to the rib 162. Specifically, the radius of curvature 184 at the first point 196 is larger than the radius of curvature 184 at the second point 198. As such, the ribs 162 compress the vacuum cleaner hose 126 less and exert a small retention force at the first point 196 than at the second point 198. The retention force and compression of vacuum cleaner hose 126 is maximized at the second point 198, or the intersection of the horizontal line from the center 186 to the ribs 162, and the retention force and compression of vacuum cleaner hose 126 is minimized at the first point 196, or the distal end 182 of hose retainers 136, 138. The lower retention force at the first point 196 allows the vacuum cleaner hose 126 to be easily inserted into the hose retention area 156, and the higher retention force at the second point 198 allows the hose retainers 136, 138 to securely retain the vacuum cleaner hose 126. As such, the ribs 162 exert a position-variable retention force on the vacuum cleaner hose 126 when the vacuum cleaner hose 126 is stored in the hose retention area 156 because the radius of curvature 184 varies by position along the ribs 162. Accordingly, the variable retention force enhances the retention capability of the hose retainers 136, 138.

The hose retainers 136, 138 described herein create a positive retention force on the vacuum cleaner hose 126. Specifically, the radius of curvature 184 is variable and smaller than the hose radius 192, exerting a variable compression force on the vacuum cleaner hose 126 when the vacuum cleaner hose 126 is stored in the hose retention area 156. As such, the vacuum cleaner hose 126 is retained in the hose retention area 156 by the positive retention force on the vacuum cleaner hose 126. Additionally, the hose retainers 136, 138 are attached to the motor cover 116, a non-sealing surface of the vacuum cleaner 100, radially inward of the outer perimeter 144, which reduces the overall foot print of the vacuum cleaner 100 and preserves the structural integrity of the sealing surfaces of the vacuum cleaner 100.

Example embodiments of vacuum cleaning systems are described above in detail. The vacuum cleaning systems are not limited to the specific embodiments described herein, but rather, components of the vacuum cleaning systems may be used independently and separately from other components described herein. For example, the hose retainer described herein may be used with a variety of vacuum cleaning systems, including and without limitation, vehicular vacuum cleaning systems, wet/dry vacuum cleaners, canister vacuum cleaners, upright vacuum cleaners, and backpack vacuum cleaners.

Embodiments disclosed herein enable enhanced vacuum cleaner performance without requiring significant or expensive modifications to other components of a vacuum cleaner. Thus, the disclosed hose retainer may be readily incorporated into existing vacuum cleaner designs. The hose retainers described herein create a positive retention force on the vacuum cleaner hose. Specifically, the radius of curvature is variable and smaller than the hose radius, exerting a variable compression force on the vacuum cleaner hose when the vacuum cleaner hose is stored in the hose retention area. As such, the vacuum cleaner hose is retained in the hose retention area by the positive retention force on the vacuum cleaner hose. Additionally, the hose retainers are attached to the motor cover, a non-sealing surface of the vacuum cleaner, radially inward of the outer perimeter which reduces the overall foot print of the vacuum cleaner and preserves the structural integrity of the sealing surfaces of the vacuum cleaner.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawings shall be interpreted as illustrative and not in a limiting sense.

What is claimed is:

1. A vacuum cleaner comprising:

a canister defining a debris chamber and having a top;

a vacuum hose adapted for fluid connection to the debris chamber, the vacuum hose having a hose diameter;

a lid having a top, the lid mounted to the top of the canister; and a motor cover mounted to the top of the lid and including at least one hose retainer, wherein the hose retainer is integrally formed with the motor cover;

wherein the hose retainer includes at least two ribs and a retention portion attached to the ribs, the ribs and the retention portion are spaced from a central portion of the motor cover to define an insertion opening, the ribs and the retention portion deflect away from a retention position in a first direction to an open position when the vacuum hose is inserted through the insertion opening;

wherein the ribs and the retention portion are biased in a second direction towards the retention position such that the ribs exert a positive retention force on the vacuum hose when the vacuum hose is positioned within the hose retainer.

2. The vacuum cleaner of claim 1, wherein the lid includes an outer perimeter that extends around the canister, and the at least one hose retainer is located radially inward form the outer perimeter.

3. The vacuum cleaner of claim 2, wherein the lid forms a perimeter seal with the canister adjacent the outer perimeter.

4. The vacuum cleaner of claim 1, wherein the motor cover is a non-sealing surface of the vacuum cleaner and the at least one hose retainer is attached directly to the motor cover.

5. The vacuum cleaner of claim 1, wherein the at least two ribs are spaced apart from one another in a longitudinal direction of the hose retainer, wherein the retention portion extends from one of the at least two ribs to another of the at least two ribs.

6. The vacuum cleaner of claim 1, wherein the at least one hose retainer comprises a first hose retainer and a second hose retainer.

7. The vacuum cleaner of claim 6, wherein the first hose retainer is attached to a first side of the motor cover and the second hose retainer is attached to a second side of the motor cover opposite the first side.

8. The vacuum cleaner of claim 1, wherein the ribs and the retention portion define an opening in the hose retainer, the opening having a width and a length.

9. The vacuum cleaner of claim 8, wherein the width of the opening is between 0.5 inches and 1.0 inches.

10. The vacuum cleaner of claim 8, wherein the length of the opening is between 3.0 inches and 3.5 inches.

11. The vacuum cleaner of claim 1, wherein each of the at least two ribs includes a curved portion and a rib tab depending from the curved portion, the curved portion defining a radius of curvature.

12. The vacuum cleaner of claim 11, wherein the radius of curvature of each of the at least two ribs is between 85% and 90% of a radius of the vacuum hose.

13. The vacuum cleaner of claim 11, wherein the rib tab engages an upper surface of the lid when the at least two ribs are in the open position to support the hose retainer.

14. The vacuum cleaner of claim 1, wherein each of the at least two ribs extends from a proximal end of the hose retainer attached to the motor cover to a free, distal end, the distal end extends over a hose retention area defined by the hose retainer and the motor cover.

15. The vacuum cleaner of claim 1 further comprising a motor and an impeller connected to the motor, the impeller operable to generate a flow of air through the canister upon operation of the motor, wherein the motor cover and the lid define a motor cavity, the motor and the impeller positioned within the motor cavity.

16. A hose storage system for storage of a vacuum hose for a vacuum cleaner, the hose storage system comprising:

a motor cover for housing at least a motor of the vacuum cleaner, the motor cover being free of sealing surfaces; and a hose retainer attached to the motor cover, the hose retainer is integrally formed with the motor cover;

wherein the hose retainer includes at least two ribs and a retention portion attached to the ribs, the ribs and the retention portion are spaced from a central portion of the motor cover to define an insertion opening, the ribs and the retention portion deflect away from a retention position in a first direction to an open position when the vacuum hose is inserted through the insertion opening;

wherein the ribs and the retention portion are biased in a second direction towards the retention position such that the ribs exert a positive retention force on the vacuum hose when positioned within the hose retainer.

17. The hose storage system of claim 16 further comprising a lid having a perimeter sealing surface adjacent an outer perimeter of the lid, wherein the perimeter sealing surface forms a perimeter seal with a canister of the vacuum cleaner.

18. The hose storage system of claim 17, wherein the hose retainer is positioned radially inward of the outer perimeter of the lid.

19. The hose storage system of claim 18, wherein the motor cover is mounted on a top of a lid.

20. A lid system for a vacuum cleaner, the lid system comprising:

a lid having an outer perimeter and a top;

a motor cover mounted to the top of the lid; and at least one hose retainer mounted to the motor cover at a location inward of the outer perimeter of the lid, wherein the hose retainer is integrally formed with the motor cover;

wherein the hose retainer includes at least two ribs and a retention portion attached to the ribs, the ribs and the retention portion are spaced from the motor cover to define an insertion opening, the ribs and the retention portion deflect away from a retention position in a first direction to an open position when a vacuum hose is inserted through the insertion opening;

wherein the ribs and the retention portion are biased in a second direction towards the retention position such that the ribs exert a positive retention force on the vacuum hose when positioned within the hose retainer.

* * * * *